US008539616B2

(12) United States Patent
Béland et al.

(10) Patent No.: US 8,539,616 B2
(45) Date of Patent: Sep. 24, 2013

(54) SHIRT FOR A HOCKEY PLAYER

(75) Inventors: Jean-François Béland, Montreal (CA); Marc Gagnon, Verdun (CA)

(73) Assignee: Bauer Hockey, Inc., Exeter, NH (US)

( * ) Notice: Subject to any disclaimer, the term of this patent is extended or adjusted under 35 U.S.C. 154(b) by 1759 days.

(21) Appl. No.: 10/942,075

(22) Filed: Sep. 16, 2004

(65) Prior Publication Data

US 2006/0053526 A1 Mar. 16, 2006

(51) Int. Cl.
*A41D 27/26* (2006.01)

(52) U.S. Cl.
USPC ..... 2/267; 2/115; 2/69

(58) Field of Classification Search
USPC ..... 2/456, 115, 244, 69
See application file for complete search history.

(56) References Cited

U.S. PATENT DOCUMENTS

| | | | | | |
|---|---|---|---|---|---|
| 2,063,469 | A | * | 12/1936 | Smith | 2/94 |
| 2,302,368 | A | * | 11/1942 | Evans | 2/94 |
| 2,493,370 | A | * | 1/1950 | Smith | 2/94 |
| 2,632,894 | A | | 3/1953 | Louis | |
| 3,174,156 | A | * | 3/1965 | Dale et al. | 2/115 |
| 3,991,420 | A | * | 11/1976 | Savarino | 2/462 |
| 4,397,636 | A | * | 8/1983 | Ganshaw | 441/65 |
| 4,937,883 | A | * | 7/1990 | Shirai | 2/115 |
| 5,010,596 | A | * | 4/1991 | Brown et al. | 2/228 |
| 5,016,291 | A | | 5/1991 | Capper | |
| 5,109,546 | A | * | 5/1992 | Dicker | 2/70 |
| 5,168,577 | A | | 12/1992 | Detty | |
| 5,201,074 | A | * | 4/1993 | Dicker | 2/70 |
| 5,210,877 | A | * | 5/1993 | Newman | 2/456 |
| 5,337,418 | A | * | 8/1994 | Kato et al. | 2/456 |
| 5,367,708 | A | * | 11/1994 | Fujimoto | 2/22 |
| 5,822,794 | A | * | 10/1998 | Allred | 2/115 |
| 7,191,470 | B2 | * | 3/2007 | Benini | 2/69 |
| 2002/0152531 | A1 | * | 10/2002 | Fusco et al. | 2/2.15 |
| 2003/0046747 | A1 | | 3/2003 | Berns | |
| 2004/0003454 | A1 | | 1/2004 | Morrow et al. | |
| 2005/0081277 | A1 | * | 4/2005 | Matechen et al. | 2/102 |
| 2005/0114978 | A1 | * | 6/2005 | Benini | 2/69 |
| 2005/0235392 | A1 | * | 10/2005 | Bay | 2/93 |

* cited by examiner

*Primary Examiner* — Richale Quinn

(57) ABSTRACT

The invention provides a shirt suitable for being worn by a sports player. The shirt comprises a torso portion having a head opening and a lower trunk opening; and first and second sleeves, each of the first and second sleeves comprising biceps, elbow and forearm portions and a gripping zone provided on one of the biceps, elbow and forearm portions. The gripping zone is made of a material having a coefficient of friction sufficient for preventing movement between said shirt and an elbow pad worn by the sports player.

18 Claims, 5 Drawing Sheets

SHIRT FOR A HOCKEY PLAYER

FIELD OF THE INVENTION

The invention relates to a shirt for a hockey player, the shirt having gripping zones for keeping an elbow pad in place.

BACKGROUND OF THE INVENTION

In many sports, players often wear protective equipment in order to avoid hurting and/or injuring themselves. For example, hockey players often wear shoulder pads, shin pads and elbow pads in order to prevent injury caused by physical contact with other players, hockey sticks, boards and pucks.

In general, the protective equipment is worn over the player's undergarment clothing, which is often made of smooth materials. As such, during the course of a hockey game, the protective equipment may move in relation to the undergarment clothing, which causes the protective equipment to move away from their intended positions.

When the protective equipment moves out of place, not only is it uncomfortable and irritating for the player, but it also means that the player may not be adequately protected until the protective equipment is moved back into its intended position. As such, not only is it distracting for the player but it opens up the possibility for the player to be hurt.

Accordingly, there is a need in the industry for a shirt for a sports player that has gripping means for maintaining the protective equipment in their intended positions, so as to alleviate at least in part the deficiencies described above.

SUMMARY OF THE INVENTION

As embodied and broadly described herein, the present invention provides a shirt suitable for being worn by a sports player, the shirt comprising a torso portion having a head opening and a lower trunk opening; and first and second sleeves, each of the first and second sleeves comprising biceps, elbow and forearm portions and a gripping zone provided on one of the biceps, elbow and forearm portions, the gripping zone being made of a material having a coefficient of friction sufficient for preventing movement between the shirt and an elbow pad worn by the sports player.

The present invention also relates to a method of customizing a shirt suitable for being worn by a sports player, the method comprising: providing to a customer a shirt comprising first and second sleeves, each of the first and second sleeves comprising biceps, elbow and forearm portions; providing to the customer a plurality of gripping zones being made of a material having a coefficient of friction sufficient for preventing movement between the shirt and an elbow pad worn by the sports player; selecting a position on one of the biceps, elbow and forearm portions of the first and second sleeves for affixing at least one of the plurality of gripping zones; and affixing the gripping zone on the selected position.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of embodiments of the present invention is provided hereinbelow with reference to the following drawings, in which.

Figure 1:
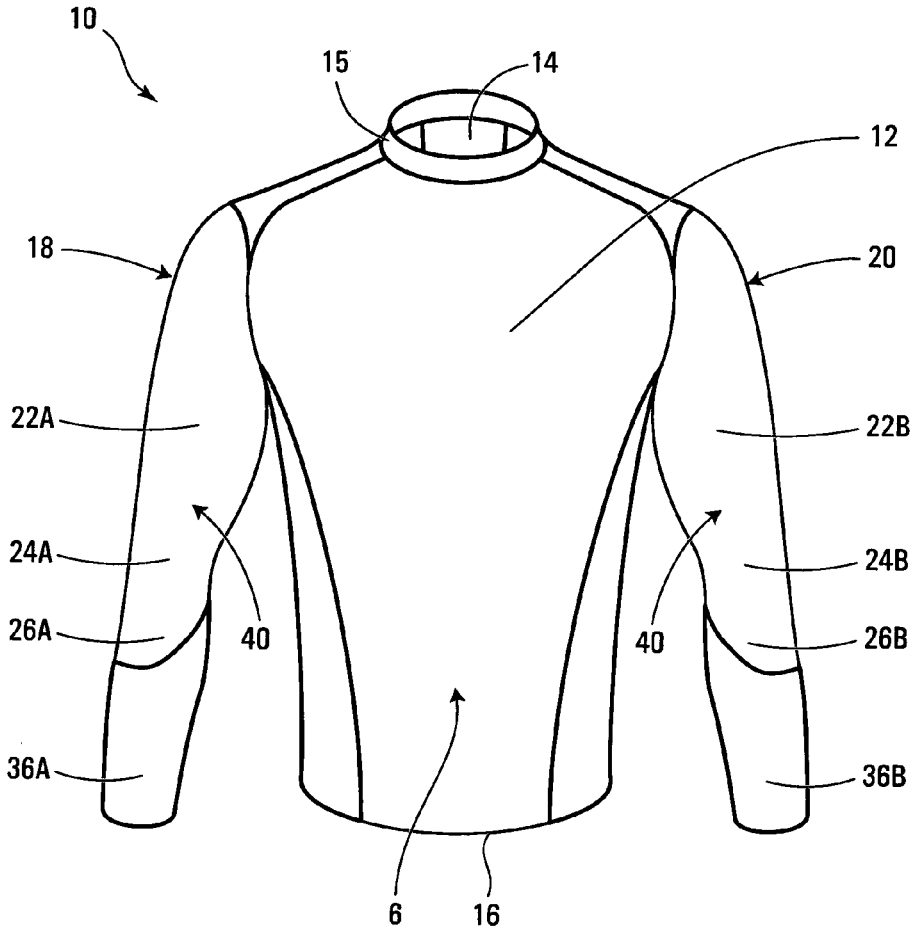
FIG. 1 shows a front view of a shirt in accordance with an embodiment of the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Figure 2:
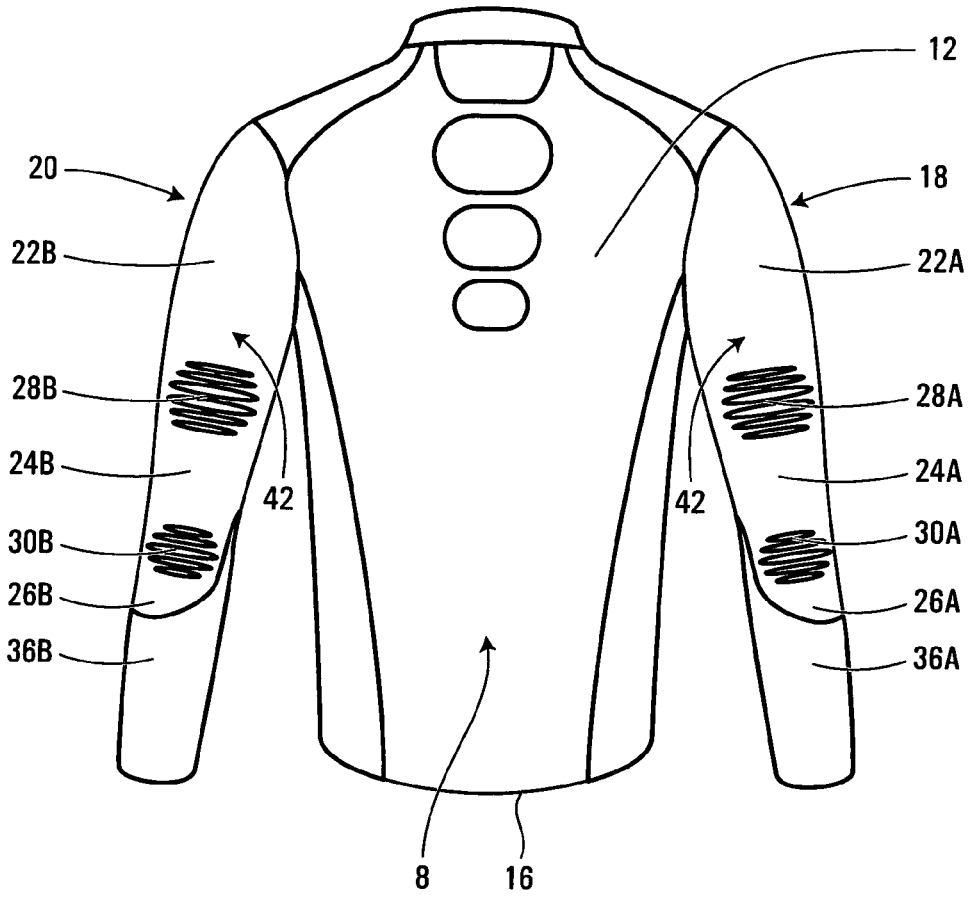
FIG. 2 shows a rear view of the shirt of FIG. 1.

Shown in FIGS. 1 and 2 is a shirt 10 in accordance with an embodiment of the present invention, the shirt 10 having respective front and back portions 6, 8. The shirt 10 is adapted for being worn by sports players who wears elbow pads. For example, the shirt 10 can be used for hockey players, or players of other sports that use elbow pads, such as lacrosse players and handball players, for example.

The shirt 10 has a torso portion 12 having a head opening 14 for receiving the head of the player and a lower trunk opening 16 for fitting around the waist and hips of the player. Surrounding the head opening 14 is a neck portion 15. The shirt 10 further has a first sleeve 18 and a second sleeve 20. The first sleeve 18 has a biceps portion 22A, an elbow portion 24A and a forearm portion 26A, and the second sleeve 20 has a biceps portion 22B, an elbow portion 24B and a forearm portion 26B. The biceps portions 22A, 22B, elbow portions 24A, 24B, and forearm portions 26A, 26B are adapted for covering the respective biceps, elbow points, and forearms of the player.

In the embodiment shown in FIGS. 1 and 2, the shirt 10 has two gripping zones on each of the sleeves 18, 20 i.e. gripping zones are provided on two of the biceps, elbow and forearm portions of each of the sleeves 18, 20. More specifically, the sleeve 18 has a gripping zone 28A on the biceps portion 22A and a gripping zone 30A on the forearm portion 26A, and the sleeve 20 has a gripping zone 28B on the biceps portion and a gripping zone 30B on the forearm portion 26B.

In an alternative embodiment that is not shown in the figures, the sleeves 18, 20 do not include gripping zones on both biceps portions 22A, 22B and forearm portions 26A, 26B. Instead the sleeves 18, 20 comprise gripping zones on only one of the biceps portions 22A, 22B, and the forearm portions 26A, 26B. For example, the sleeves 18, 20 can include only the gripping zones 28A, 28B on the respective biceps portions 22A, 22B, and no gripping zones on the respective forearm portions 26A, 26B. Or alternatively, the sleeves 18, 20 can include only gripping zones 30A, 30B on the respective forearm portions 26A, 26B and no gripping zones on the respective biceps portions 22A, 22B.

Shown in FIGS. 3A through 3F are shirts 40, 50, 60, 70, 80 and 90 in accordance with alternative embodiments of the present invention. Each of the shirts 40, 50, 60, 70, 80 and 90 has an alternative, non-limiting, configuration of gripping zones that is included within the spirit of the invention. For the sake of simplicity, the sleeves, the biceps portions, the elbow portions and the forearm portions of the shirts 40, 50, 60, 70, 80 and 90 will be referred to with the same reference numerals as used in FIGS. 1 and 2.

Figure 3A:
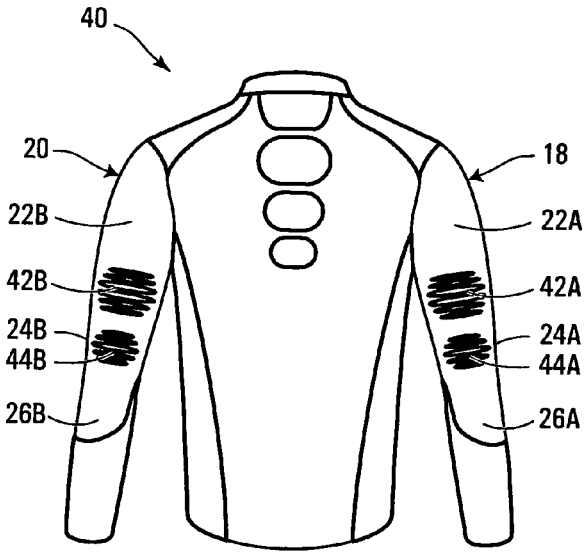
FIG. 3A shows a rear view of a shirt in accordance with a second embodiment of the present invention.

Shown in FIG. 3A, is a shirt 40 having a first alternative configuration of gripping zones. The shirt 40 has gripping zones 42A, 42B on the respective biceps portions 22A, 22B of the sleeves 18, 20, and gripping zones 44A, 44B on the respective elbow portions 24A, 24B of the sleeves 18, 20. In this embodiment, there are no gripping zones on the forearm portions 26A, 26B.

Figure 3B:
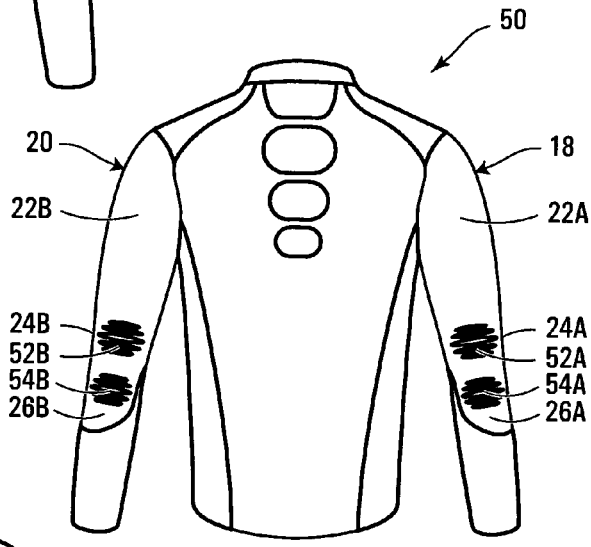
FIG. 3B shows a rear view of a shirt in accordance with a third embodiment of the present invention.

Shown in FIG. 3B, is a shirt 50 having a second alternative configuration of gripping zones. The shirt 50 has gripping zones 54A, 54B on the respective forearm portions 26A, 26B of the sleeves 18, 20, and gripping zones 52A, 52B on the respective elbow portions 24A, 24B of the sleeves 18, 20. In this embodiment, there are no gripping zones on the biceps portions 22A, 22B.

Figure 3C:
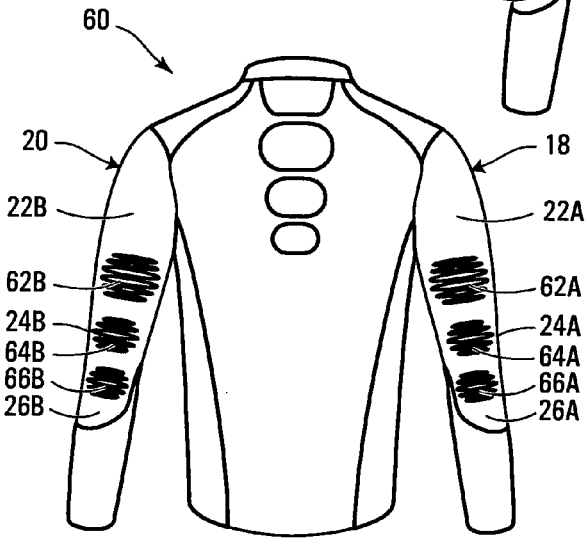
FIG. 3C shows a rear view of a shirt in accordance with a fourth embodiment of the present invention.

Shown in FIG. 3C, is a shirt 60 having a third alternative configuration of gripping zones. The shirt 60 has gripping zones 62A, 62B on the respective biceps portions 22A, 22B of the sleeves 18, 20, gripping zones 64A, 64B on the respective elbow portions 24A, 24B of the sleeves 18, 20 and gripping zones 66A, 66B on the respective forearm portions 26A, 26B of the sleeves 18, 20. In this embodiment gripping zones are provided on all three biceps, elbow and forearm portions of the sleeves 18, 20.

Figure 3D:
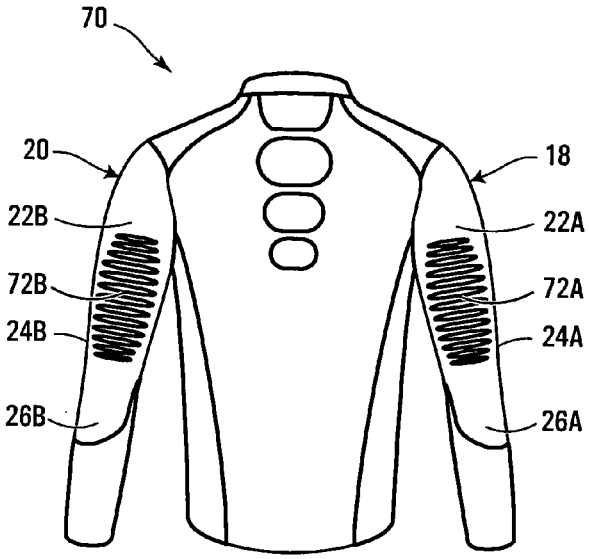
FIG. 3D shows a rear view of a shirt in accordance with a fifth embodiment of the present invention.
Figure 3E:
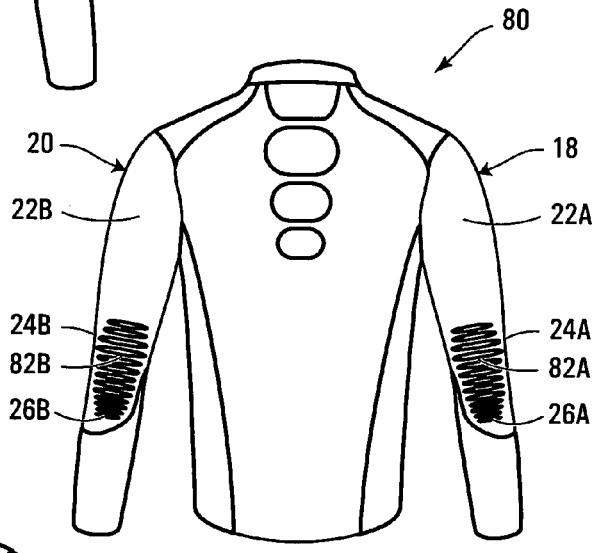
FIG. 3E shows a rear view of a shirt in accordance with a sixth embodiment of the present invention.
Figure 3F:
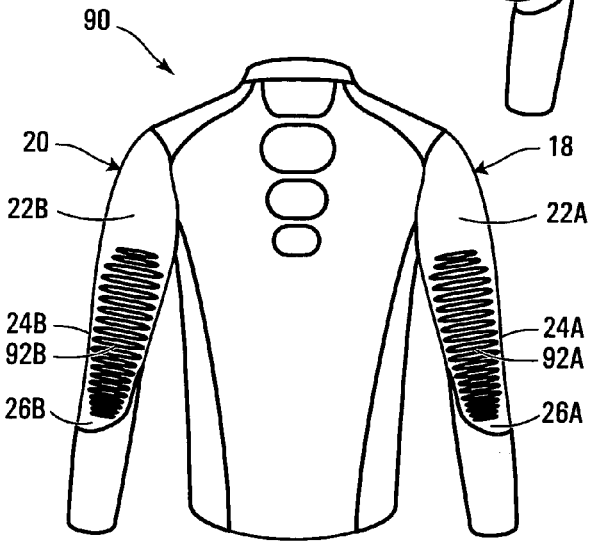
FIG. 3F shows a rear view of a shirt in accordance with a seventh embodiment of the present invention.

In the embodiments shown in FIGS. 3D through 3F, instead of including separate gripping zones in the biceps portions 22A, 22B, elbow portions 24A, 24B and forearm portions 26A, 26B, each of the sleeve 18, 20 has a single gripping zone that covers two or more of the biceps, elbow and forearm portions.

Shown in FIG. 3D is a shirt 70 having a fourth alternative configuration of gripping zones. In this embodiment, the sleeve 18 has a single gripping zone 72A provided on both the biceps portion 22A and the elbow portion 24A, and the sleeve 20 has a single gripping zone 72B provided on both the biceps portion 22B and the elbow portion 24B.

Shown in FIG. 3E is a shirt 80 having a fifth alternative configuration of gripping zones. In this embodiment, the sleeve 18 has a single gripping zone 82A provided on both the elbow portion 24A and the forearm portion 26A, and the sleeve 20 has a single gripping zone 82B provided on both the elbow portion 24B and the forearm portion 26B.

Shown in FIG. 3F is a shirt 90 having a sixth alternative configuration of gripping zones. In this embodiment, the sleeve 18 has a single gripping zone 92A provided on all of the biceps portion 22A, the elbow portion 24A and the forearm portion 26A and the sleeve 20 has a single gripping zone 92B provided on all three of the biceps portion 22B, the elbow portion 24B and the forearm portion 26B.

Referring back to FIGS. 1 and 2, each of the sleeves 18, 20 of the shirt 10 has inner and outer arm portions 40, 42. It should be appreciated that gripping zones may be provided on the outer arm portion 42 of each of the sleeves 18, 20 and/or on the inner arm portion 40 of each of the sleeves 18, 20.

Figure 4:
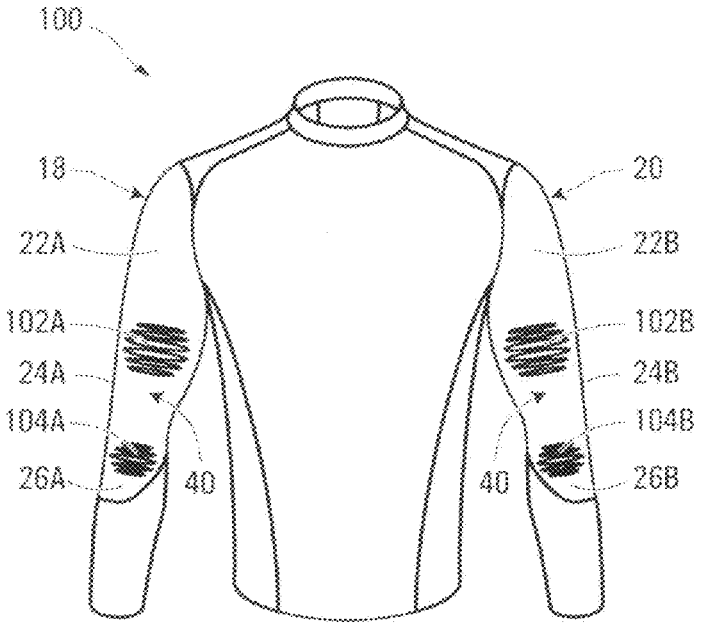
FIG. 4 shows a front view of a shirt in accordance with an eighth embodiment of the present invention.

FIG. 4 shows a shirt 100 having gripping zones on the inner arm portion 40 of each of the sleeves 18, 20. More specifically, the sleeve 18 has a gripping zone 102A on the biceps portion 22A and a gripping zone 104A on the forearm portion 26A, and the sleeve 20 has a gripping zone 102B on the biceps portion 22B and a gripping zone 104B on the forearm portion 26B. All of the gripping zones 102A, 102B and 104A, 104B are provided on the inner arm portions 40 of the sleeves 18, 20. It should be appreciated that a shirt that has gripping zones provided on both the inner and outer arm portions 40, 42 is also included within the scope of the present invention.

In addition, although FIG. 4 shows the gripping zones 102A, 102B, 104A and 104B as being on the biceps portions 22A, 22B and the forearm portions 26A, 26B, it should be understood that the inner arm portions 40 of the sleeves 18, 20 can include gripping zones in any of the configurations described above with respect to FIGS. 3A through 3F.

Figure 5:
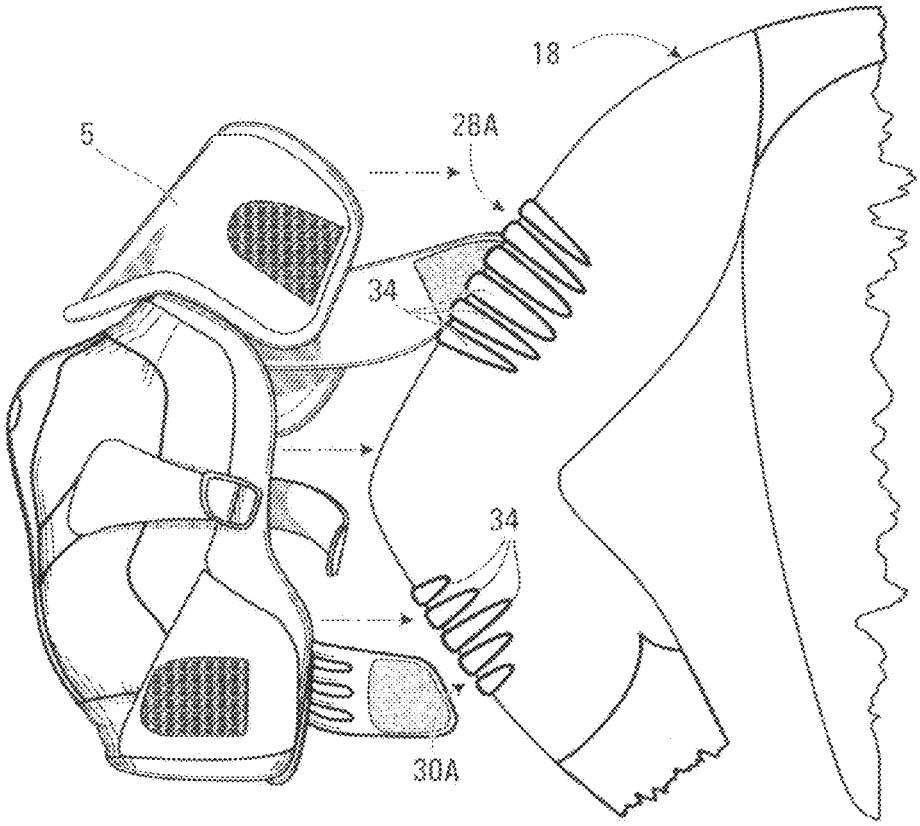
FIG. 5 shows an expanded view of a sleeve of the shirt of FIG. 1, with an elbow pad positioned in proximity thereto.

Shown in FIG. 5 is the sleeve 18 of the shirt 10 shown in FIGS. 1 and 2. The sleeve 18 has the gripping zone 28A on the biceps portion 22A, and the gripping zone 30A on the forearm portion 26A. In use, when the player puts on an elbow pad 5, the gripping zones 28A and 30A help to keep the elbow pad 5 in place, and seek to prevent the elbow pad 5 from rotating or sliding up or down the arm.

The material, shape and surface finish of the gripping zones will now be described with respect to gripping zones 28A and 30A shown in FIGS. 1, 2 and 5. It should however be appreciated that all of the gripping zones are made of a material having a coefficient of friction sufficient for preventing movement between the shirt and the elbow pad worn by the sports player.

As shown in FIG. 5, the gripping zones 28A, 30A are formed of bands 34 of a gripping material. The gripping material is a material that increases the frictional engagement between an inner surface of the elbow pad 5 and the sleeve 18. For example, the gripping zone may be made of rubber or flexible plastic that has a relatively high coefficient of friction. Examples of suitable materials are thermoplastic rubber (santoprene), polyurethane (thermoplastic or thermoset), polyvinyl chloride (PVC) and silicone. The gripping zone may also comprise VELCRO loops or VELCRO hooks, which may prevent movement between the shirt and the elbow pad. In the case of VELCRO loops, the inner surface of the elbow pad may comprise corresponding zone The bands 34 form an overall bumpy surface for the gripping zones 28A, 30A. The fact that the gripping zones 28A, 30 form a bumpy surface may further increase the frictional engagement between the gripping zones and the inner surface of the elbow pad 5. In an alternative embodiment, it should be understood that the gripping zones 28A, 30A could be formed of a single piece of the gripping material, that forms a smooth surface. In addition, the gripping zones 28A, 30A could include other surface finishes that also help to increase the frictional engagement, such as overlapping ridges, or a quilted surface, for example.

In the embodiments shown in FIGS. 2 and 5, the gripping zones 28A, 30A are of a generally oval shape. It should however be understood that the gripping zones 28A, 30A could be of any other shape without departing from the spirit of the invention. For example, the gripping zones 28A, 30A could be square shaped, circular shaped, triangular shaped, star shaped etc.

The shirts 10, 40, 50, 60, 70, 80, 90 and 100 in accordance with the present invention (which will now be referred to collectively as "the shirts") may be made of a light-weight synthetic material that is able to move moisture away from the skin of the player, and enable faster evaporation of sweat. For example, the shirts can be made of polyester material, a polyester/spandex blend, or a polyester/nylon/spandex blend, among other possibilities. It should be understood that the shirts can be made entirely of one material, or can be made of panels of different materials.

The gripping zones described above can be affixed to the shirts in a variety of different manners known in the art, such as by printing them on, or applying them via adhesive, sewing, or thermal bonding, for example.

The shirt and the gripping zones may be sold in a package, in order to provide a method of customizing the shirt by providing to a customer a shirt and a plurality of gripping zones being made of a material having a coefficient of friction sufficient for preventing movement between the shirt and the elbow pad. The customer may select a position on one of the biceps, elbow and forearm portions of the sleeves for affixing at least one of the plurality of gripping zones and the gripping zone is afterward affixed on the selected position.

Referring back to FIG. 1, the sleeves 18, 20 include wrist portions 36A, 36B respectively. In a non-limiting embodiment, each of the wrist portions 36A, 36B has a pocket for receiving a wrist guard (not shown in FIG. 1) for protecting the wrist of the player. Wrist guards, and shirts having pockets for receiving wrist guards are known in the art, and as such will not be described in more detail herein.

In addition, the neck portion 15 of the shirt 10 can be designed and manufactured in order to receive a neck guard (not shown in FIG. 1). Neck guards and shirts having neck portions for receiving neck guards are known in the art and as such will not be described in more detail herein.

The above description of embodiments should not be interpreted in a limiting manner since other variations, modifications and refinements are possible within the spirit and scope of the present invention. The scope of the invention is defined in the appended claims and their equivalents.

The invention claimed is:

1. A hockey shirt suitable for being worn by a hockey player having arms, each arm having an inside portion, an outer portion, biceps, an elbow point and a forearm, said hockey shirt comprising:

(a) a torso portion having a head opening and a lower trunk opening; and (b) first and second sleeves, each of said first and second sleeves extending along a longitudinal axis and comprising biceps, elbow and forearm portions, inside and outer arm portions for facing the respective inside and outer portions of the arm, and a gripping zone provided on one of said biceps, elbow and forearm portions, said gripping zone being provided on said outer arm portion of said sleeve and being formed of a plurality of separate bands being generally transverse relative to the longitudinal axis of said sleeve and wherein, when said shirt is worn by the hockey player, said separate bands face a hockey elbow pad worn by the hockey player on said outer arm portion of said sleeve for protecting the elbow point of the arm, said separate bands having a coefficient of friction sufficient for preventing movement between said sleeve and the hockey elbow pad.

2. A shirt as defined in claim 1, wherein said gripping zone is provided on two of said biceps, elbow and forearm portions of each of said first and second sleeves.

3. A shirt as defined in claim 2, wherein said gripping zone comprises first and second gripping zones, said first gripping zone being provided on said biceps portion of each of said first and second sleeves and said second gripping zone being provided on said forearm portion of each of said first and second sleeves.

4. A shirt as defined in claim 2, wherein said gripping zone comprises first and second gripping zones, said first gripping zone being provided on said elbow portion of each of said first and second sleeves and said second gripping zone being provided on said forearm portion of each of said first and second sleeves.

5. A shirt as defined in claim 2, wherein said gripping zone comprises first and second gripping zones, said first gripping zone being provided on said biceps portion of each of said first and second sleeves and said second gripping zone being provided on said elbow portion of each of said first and second sleeves.

6. A shirt as defined in claim 1, wherein said gripping zone comprises provided on all three of said biceps, elbow and forearm portions of each of said first and second sleeves.

7. A shirt as defined in claim 6, wherein said gripping zone comprises first and second gripping zones, said first gripping zone being provided on said biceps and elbow portions of each of said first and second sleeves and said second gripping zone being provided on said forearm portion of each of said first and second sleeves.

8. A shirt as defined in claim 6, wherein said gripping zone comprises first and second gripping zones, said first gripping zone being provided on said biceps portion of each of said first and second sleeves and said second gripping zone being provided on said elbow and forearm portions of each of said first and second sleeves.

9. A shirt as defined in claim 6, wherein said gripping zone comprises first, second and third gripping zones, said first, second and third gripping zones being provided on said respective biceps, elbow and forearm portions of each of said first and second sleeves.

10. A shirt as defined in claim 1, wherein each of said first and second sleeves comprises inner and outer arm portions, said gripping zone being provided on said outer arm portion.

11. A shirt as defined in claim 1, wherein each of said first and second sleeves comprises a wrist portion.

12. A shirt as defined in claim 1, wherein said shirt is made of a synthetic material.

13. A shirt as defined in claim 12, wherein said synthetic material is a polyester/spandex blend.

14. A shirt as defined in claim 1, wherein said gripping zone is made of rubber.

15. A shirt as defined in claim 1, wherein said gripping zone comprises loops or hooks.

16. A shirt as defined in claim 1, wherein said separate bands of said gripping zone of each of said first and second sleeves form a bumpy surface.

17. A combination comprising (i) a hockey shirt suitable for being worn by a hockey player having arms, each arms having an inside portion, an outer portion, biceps, an elbows point and a forearms, and (ii) a hockey elbow pad for protecting and encircling at least partially the biceps, elbow point and forearm of the hockey player, said hockey shirt comprising (a) a torso portion having a head opening and a lower trunk opening; and (b) first and second sleeves, each of said first and second sleeves extending along a longitudinal axis and comprising biceps, elbow and forearm portions, inside and outer arm portions for facing the respective inside and outer portions of the arm, and a gripping zone provided on one of said biceps, elbow and forearm portions, said gripping zone being provided on said outer arm portion of said sleeve and being formed of a plurality of separate bands being generally transverse relative to the longitudinal axis of said sleeve and wherein said hockey elbow pad is worn by the hockey player on said outer arm portion of said sleeve for protecting the elbow point of the arm and said separate hands face said hockey elbow pad, bands having a coefficient of friction sufficient for preventing movement between said sleeve and said elbow pad.

18. A combination as defused in claim 17, wherein said separate bands of said gripping zone of each of said first and second sleeves form a bumpy surface.

* * * * *

UNITED STATES PATENT AND TRADEMARK OFFICE

CERTIFICATE OF CORRECTION

PATENT NO. : 8,539,616 B2
APPLICATION NO. : 10/942075
DATED : September 24, 2013
INVENTOR(S) : Béland et al.

It is certified that error appears in the above-identified patent and that said Letters Patent is hereby corrected as shown below:

In the Claims

In claim 17, column 7:

- line 3, the word “hands” should read “bands”; and

- line 4, the words “said separate” are missing between the “,” and the word “bands”.

Signed and Sealed this
Fourth Day of February, 2014

Michelle K. Lee

Michelle K. Lee
*Deputy Director of the United States Patent and Trademark Office*